United States Patent [19]

Sheldon

[11] Patent Number: 4,879,268

[45] Date of Patent: Nov. 7, 1989

[54] MULTIPLE DOCUMENT PARALLEL PRINTING APPARATUS

[76] Inventor: Dunstan P. Sheldon, 1752 W. Altadena, Altadena, Calif. 91001

[21] Appl. No.: 31,703

[22] Filed: Mar. 30, 1987

[51] Int. Cl.[4] ..... B41M 5/22

[52] U.S. Cl. ..... 503/201; 427/150; 427/151; 428/913; 428/914; 503/226

[58] Field of Search ..... 503/201, 226; 427/150–152; 428/913, 914

[56] References Cited

U.S. PATENT DOCUMENTS

| | | | |
|---|---|---|---|
| 4,251,593 | 2/1981 | Sakamoto et al. | 428/913 |
| 4,529,993 | 7/1985 | Watanabe et al. | 503/208 |
| 4,538,164 | 8/1985 | Takigawa et al. | 503/209 |
| 4,547,788 | 10/1985 | Kurisu | 503/208 |
| 4,562,448 | 12/1985 | Watanabe et al. | 503/208 |

FOREIGN PATENT DOCUMENTS

| | | | |
|---|---|---|---|
| 0050308 | 4/1982 | European Pat. Off. | 502/201 |
| 0012693 | 1/1982 | Japan | 503/226 |

*Primary Examiner*—Bruce H. Hess

*Attorney, Agent, or Firm*—William W. Haefliger

[57] ABSTRACT

Multiple sheets are simultaneously thermally printed, the sheet having coatings located to enable same.

2 Claims, 1 Drawing Sheet

MULTIPLE DOCUMENT PARALLEL PRINTING APPARATUS

BACKGROUND OF THE INVENTION

This invention relates generally to thermal printing, and more particularly to production of multiple thermally printed sheets, such as an "original" and one or more "duplicate" sheets.

Thermal printing has many advantages over impact printing. It is very quiet and has very few moving parts, especially when a thermal linear head is used. Today there are basically three ways to print using thermal head technology The first and oldest method is called "direct thermal printing", the second is thermal transfer, and the third is a variation of thermal transfer.

In direct thermal printing the sheet or paper is coated with a thermal coating containing visually a leuco dye which is exposed when heat is applied by the thermal elements in the thermal head.

Thermal transfer printing employs a plain paper and a thermal ribbon which is coated with a thermo-fusible ink layer containing wax and a colored pigment. The images are transferred to the receiving sheet by the application of heat to the thermal-fusible ink layer. The thermal transfer ribbon can also be made with a sublimable dye layer or an organic-solvent-soluble dye layer and wax.

The variant method uses a leuco dye layer on the image transfer ribbon and a color developer layer on the receiving sheet of paper. In this system the leuco dye when heated reacts with the developer and induces color formation in the leuco dye; and the image is formed on the receiving sheet.

There is need for "two-ply" thermal printing, wherein an "original" and one or more "duplicate" printed sheets are produced, thermally. Prior attempts used a thermo-fusible ink layer containing a wax and colored pigment. This made the top sheet unacceptable because of a black carbon looking coating on the back side. Customer did not accept this, as it would "ink" their hands or clothing.

SUMMARY OF THE INVENTION

It is a major object of the invention to provide method and means to produce clearly legible multiple thermally printed sheets, without need for thermo-fusible ink layers.

Basically, the method of thermal printing in accordance with the invention includes:

(a) providing a first paper sheet having a coating on one side thereof, the coating consisting of color developer, (b) providing a second paper sheet having a dye coating on one side thereof, and locating the dye coating in facing relation to the color developer layer, (c) the second paper sheet provided with a thermal coating at the opposite side thereof, the thermal coating containing a leuco dye exposed when heat is applied to said coating from the thermal head.

Typically, the method contemplates transferring heat from the head to the two sheets, as referred to, to produce the printing on each sheet. As will be seen, the method further may include urging said sheets relatively toward one another between said thermal head and a backer as the sheets travel lengthwise together relative to the head and backer, while transferring heat from said head to said sheets. In this regard, the backer may comprise a roller over which the two sheets pass and are held in adjacent relation between the heat transfer head and the roller. For line printing the head and rollers are elongated and parallel, and the method includes the step of orienting the head and roller widthwise of said sheets which are elongated and travel lengthwise relative to the head and roller; and for serial printing the roller is elongated and oriented widthwise of the sheets which are elongated and travel lengthwise over the roller, the head being traveled widthwise of the sheets, generally parallel to the roller.

These and other objects and advantages of the invention, as well as the details of illustrative embodiment, will be more fully understood from the following specification and drawings, in which:

DRAWING DESCRIPTION

DETAILED DESCRIPTION

Figure 1:
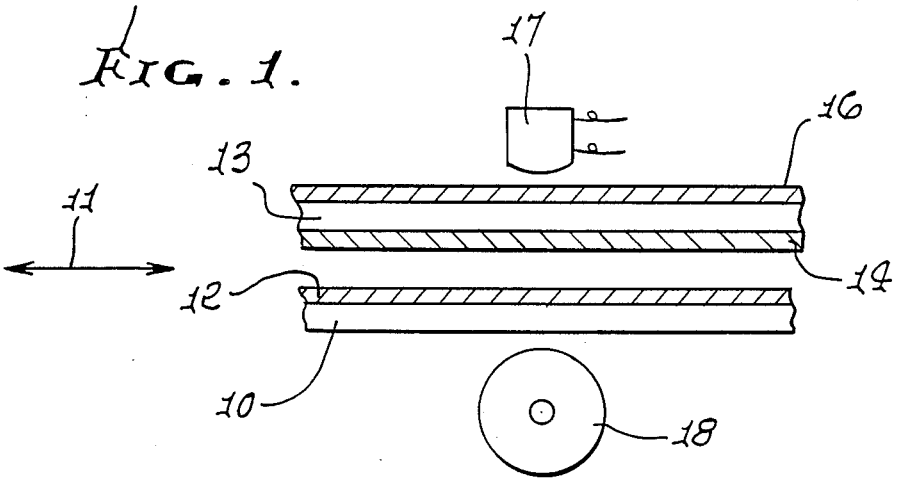
FIG. 1 is an exploded view showing the elements of the invention.

Referring to FIG. 1, a first paper sheet 10 is elongated in travel direction 11, and has a coating 12 on one side (upper side) thereof. That coating consist of color developer, examples of which are disclosed in one or more of U.S. Pats. Nos. 4,562,448; 4,547,788; 4,538,164; 4,529,993; and 4,251,593.

The paper sheet 10 thickness coating 12 and 14 thicknesses are of the order described in the above patents.

Also provided is a second paper sheet 13 which is elongated in direction 11 It has a dye coating 14 on one side (lower) thereof to face coating 12. Examples of coating 14 are leuco dyes in carriers, as per one or more of the above patents.

The paper sheet 13 thickness is normally less than the thickness of paper 10, i e. like that of known FAX paper.

Further, the second sheet 13 is provided with a thermal coating 16 at the opposite (upper) side thereof. Coating 16 typically contains a leuco dye, colorless to the eye, exposed at locations opposite heat sources when heat is locally applied to that coating as from a thermal head 17. Examples of coating 16 (direct thermal paper) are produced by Ricoh Co. Ltd., Japan; NCR Corporation, Dayton, Ohio and Appleton Paper Co., Appleton, Wisconsin.

The thickness of coating 16 is about the same as that of known FAX paper.

In use, the coating 14 has surface contact with coating 12; a roller 18 locally engages the underside of sheet 10; and heat transfer head 17 has an under-surface 17*a* in local engagement with coating 16, directly opposite the roller 18 contact with sheet 10. Heat is then locally transferred from the head to coating 16, to sheet 13, to coating 14 and coating 12, in the zone between head 18 and roller 18 As an example, the temperature of the selected heated elements is between 60° C. and 80° C. at their undersurfaces, and the sheets travel in direction 11 at a speed of about 1–2 inches per second. Progressive thermal printing then occurs due to selected energization of the heated elements of the head.

Figure 2:
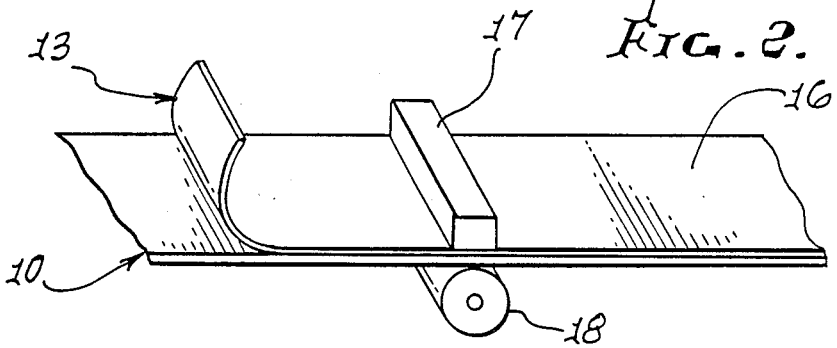
FIG. 2 is a perspective view showing line printing.

FIG. 2 shows one such mode of progressive printing, with both head 17 and roller 18 elongated widthwise of the two sheets held in compressed together relation between 17 and 18 as the sheets travel endwise Printing occurs along the lines of contact of 17 and 18 with the sheets.

Figure 3:
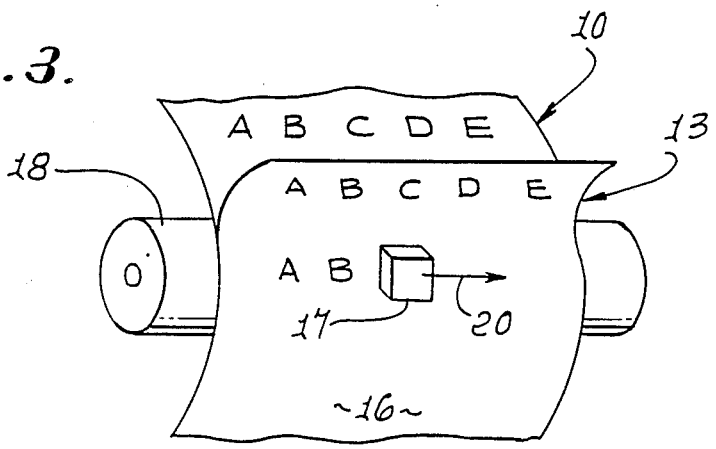
FIG. 3 is a perspective view showing serial printing.

FIG. 3 shows another such mode of progressive printing, with roller 18 elongated widthwise of the two sheets held compressed between local head 17 and the roller 18. Printing occurs serially (see characters) as the head is traveled back and forth, widthwise of the sheet (see arrow 20)., Note that "duplicate" sheets with thermally printed alpha-numeric characters are thus formed The invention contemplates formation of more than two printed sheets, if desired.

The head 17 contains heat elements individually controlled by suitable circuitry to selectively instantaneously heat the elements to produce selected alphanumeric or graphic characters. Such heat is instantaneously transferred to the coatings as described to cause corresponding character formation at the surfaces of coatings 16 and 12. The two sheets then separate. A known head 17 is that sold by Rohm, Japan, Type KH 135-2, for example.

I claim:

1. In the method of thermal printing on multiple sheets and employing a thermal head, the steps including (a) providing a first paper sheet having a coating on one side thereof, the coating consisting of color developer, (b) providing a separate and second paper sheet having a leuco dye coating on one side thereof and bringing the sheets together to locate the dye coating in facing relation to the color developer layer, to contact same, the second paper sheet readily separable from the first paper sheet.

(c) providing said thermal head to contain electrically heated elements forming alphanumeric or graphic characters, (d) the second paper sheet provided with a thermal coating at the opposite side thereof, the thermal coating containing a leuco dye and color developer therefor characterized as becoming exposed at locations where heat is applied to said coating from the heated elements at the thermal head, (e) and providing a backer and locally urging said sheets relatively toward one another between said thermal head and the backer while traveling the sheets lengthwise together relative to the head and backer, at between 1 and 2 inches per second and while locally and simultaneously transferring heat from said head elements to said sheets, via the thermal coating, (f) said backer comprising a roller, and said sheets being held in adjacent relation between said head and roller, (g) said roller being elongated, and including the step of orienting said roller widthwise of said sheets which are elongated and traveled lengthwise relative to the head and roller.

2. The method of claim 1 including also traveling the head widthwise of the sheets, generally parallel to the roller.

* * * * *